US009994385B2

(12) United States Patent
Dudi et al.

(10) Patent No.: US 9,994,385 B2
(45) Date of Patent: Jun. 12, 2018

(54) SHIPPING CONTAINER WITH MULTIPLE TEMPERATURE ZONES

(71) Applicant: GOOGLE INC., Mountain View, CA (US)

(72) Inventors: Abhijeet Dudi, San Jose, CA (US); Prateek Khanna, Santa Clara, CA (US); Rohit Aggarwal, San Francisco, CA (US)

(73) Assignee: GOOGLE LLC, Mountain View, CA (US)

( * ) Notice: Subject to any disclaimer, the term of this patent is extended or adjusted under 35 U.S.C. 154(b) by 187 days.

(21) Appl. No.: 15/174,556

(22) Filed: Jun. 6, 2016

(65) Prior Publication Data

US 2017/0349356 A1 Dec. 7, 2017

(51) Int. Cl.
*F25D 3/06* (2006.01)
*F25D 3/12* (2006.01)
(Continued)

(52) U.S. Cl.
CPC ..... *B65D 81/3825* (2013.01); *B65D 25/04* (2013.01); *B65D 25/16* (2013.01); *F25D 3/06* (2013.01); *F25D 3/125* (2013.01)

(58) Field of Classification Search
CPC .. F25D 3/06; F25D 3/12; B65D 25/04; B65D 81/3825; B65D 25/16; B62B 2204/06
See application file for complete search history.

(56) References Cited

U.S. PATENT DOCUMENTS 1,825,068 A * 9/1931 Jones ..... F25D 3/125 229/103.11
2,008,906 A 7/1935 Ginsberg
(Continued)

FOREIGN PATENT DOCUMENTS

JP 10-306964 A 11/1998
JP 2005-104567 A 4/2005

OTHER PUBLICATIONS

Diaz, "U.S. Office Action issued in copending U.S. Appl. No. 15/174,582, filed Jun. 6, 2016", dated Oct. 17, 2017, 18 pages.
(Continued)

*Primary Examiner* — Kun Kai Ma
(74) *Attorney, Agent, or Firm* — Johnson, Marcou & Isaacs, LLC

(57) ABSTRACT

Delivering items to users by a delivery organization comprises a recyclable delivery container suitable to hold multiple items at different temperatures for the duration of the delivery. The delivery container may be a cube or a rectangular prism constructed of an insulating material. The delivery organization may position panels in the delivery container to separate two or three compartments of the delivery container, each compartment to be cooled to a different temperature than the others. The panels are constructed of an insulating material created by recyclable layers of cardboard and plastic. The delivery organization determines an appropriate coolant to cool all three compartments based on heat transfer requirements of the compartments and positions the coolant in the bottom of the first compartment. The items are placed in the appropriate compartments of the delivery container. Vents can be provided to relieve pressure created by the coolant.

20 Claims, 3 Drawing Sheets

(51) Int. Cl.

| | |
|---|---|
| ***B65D 81/38*** | (2006.01) |
| ***B65D 25/04*** | (2006.01) |
| ***B65D 25/16*** | (2006.01) |

(56) References Cited

U.S. PATENT DOCUMENTS

| | | | | |
|---|---|---|---|---|
| 2,325,371 | A * | 7/1943 | Clerc | B65D 81/18 220/592.05 |
| 3,236,206 | A * | 2/1966 | Willinger | A01K 63/02 119/203 |
| 4,294,079 | A | 10/1981 | Benson | |
| 4,781,475 | A | 11/1988 | LaFleur | |
| 5,218,923 | A * | 6/1993 | LaRosa | A01K 63/02 119/201 |
| 5,292,093 | A | 3/1994 | Shumake | |
| 5,363,670 | A | 11/1994 | Bartilucci | |
| 5,598,713 | A | 2/1997 | Bartilucci | |
| 6,325,281 | B1 * | 12/2001 | Grogan | B65D 81/3862 220/592.25 |
| 6,457,323 | B1 * | 10/2002 | Marotta | B65D 25/06 62/371 |
| 6,520,323 | B1 | 2/2003 | Colombo | |
| 6,763,678 | B2 | 7/2004 | Harper | |
| 6,895,778 | B1 | 5/2005 | Ackerman | |
| 7,950,249 | B1 | 5/2011 | White et al. | |
| 8,424,319 | B2 | 4/2013 | Whewell, Jr. | |
| 8,424,335 | B2 * | 4/2013 | Corder | A61J 1/165 229/103 |
| 9,751,682 | B2 * | 9/2017 | Mayer | B65D 81/3813 |
| 2002/0050147 | A1 * | 5/2002 | Mai | F25D 3/08 62/457.2 |
| 2003/0173361 | A1 * | 9/2003 | Lee | B65D 21/0233 220/23.88 |
| 2004/0069009 | A1 | 4/2004 | Tedder | |
| 2004/0151851 | A1 * | 8/2004 | Miller | B65D 81/18 428/34.2 |
| 2004/0231355 | A1 * | 11/2004 | Mayer | C09K 5/063 62/371 |
| 2005/0016198 | A1 * | 1/2005 | Wowk | A01N 1/02 62/371 |
| 2005/0053315 | A1 | 3/2005 | Aasen | |
| 2006/0053828 | A1 | 3/2006 | Shallman et al. | |
| 2006/0174648 | A1 * | 8/2006 | Lantz | B65D 81/3816 62/371 |
| 2007/0032774 | A1 * | 2/2007 | Glade | A61J 1/165 604/403 |
| 2007/0157534 | A1 * | 7/2007 | Green | B60R 7/02 52/270 |
| 2008/0197139 | A1 * | 8/2008 | Goncharko | F25D 3/06 220/592.25 |
| 2008/0308452 | A1 * | 12/2008 | Eller | G06Q 10/08 206/756 |
| 2012/0222390 | A1 | 9/2012 | Fux | |
| 2014/0021208 | A1 * | 1/2014 | Anti | A01N 1/0273 220/592.25 |
| 2015/0021327 | A1 * | 1/2015 | Kuo | B65D 51/20 220/254.9 |
| 2015/0238033 | A1 | 8/2015 | Zavitsanos | |
| 2016/0046429 | A1 * | 2/2016 | Bray | B65D 81/3818 220/577 |
| 2017/0023289 | A1 | 1/2017 | Anderson | |
| 2017/0043907 | A1 * | 2/2017 | Drendel | B65D 25/04 |
| 2017/0254580 | A1 | 9/2017 | Hiller et al. | |
| 2017/0276420 | A1 | 9/2017 | Yu et al. | |
| 2017/0307278 | A1 | 10/2017 | Chandran et al. | |
| 2017/0350635 | A1 | 12/2017 | Thirumurugavel | |

OTHER PUBLICATIONS

Attel, "U.S. Office Action issued in copending U.S. Appl. No. 15/364,217, filed Nov. 29, 2016", dated Nov. 1, 2017, 15 pages.

U.S. Appl. No. 15/134,217 to Chandran et al. filed Apr. 20, 2016.

U.S. Appl. No. 15/174,582 to Ilangovan Poonjolai Thirumurugavel filed Jun. 6, 2016.

U.S. Appl. No. 15/364,217 to Thirumurugavel et al. filed Nov. 29, 2016.

Attel, "U.S. Office Action issued in copending U.S. Appl. No. 15/364,217, filed Nov. 29, 2016", dated Apr. 19, 2017, 11 pages.

Nouketcha, "U.S. Office Action issued in copending U.S. Appl. No. 15/134,217, filed Apr. 26, 2016", dated Mar. 14, 2018, 23 pages.

* cited by examiner

SHIPPING CONTAINER WITH MULTIPLE TEMPERATURE ZONES

TECHNICAL FIELD

The present disclosure relates to improving the delivery of passively cooled products in segmented, recyclable containers. The products in different compartments of the container are maintained at different temperatures through the use of insulating barriers separating the compartments from a coolant and from each other. The container will allow a shipper to use a single container to deliver products that require different shipping temperatures to a user.

BACKGROUND

When shippers and other delivery companies ship products to users, the products often require cooling. For example, if a user orders dairy products from a grocery store for delivery, the products may require a container that maintains a temperature below a specified temperature to prevent spoilage. In some instances, certain products in an order require different amounts of cooling than other products. For example, an order from the grocery store may include dairy products that require a shipping temperature of 32-35 degrees F. and frozen items that require a shipping temperature of less than 32 degrees F., such as 0 degrees F. Typically, delivery companies will ship products requiring different shipping temperatures via separate containers.

Current applications for delivering products to a user do not allow different cooled temperature zones in the same recyclable delivery container.

SUMMARY

Techniques herein provide a delivery container for delivering items to users by a delivery organization. The delivery container is suitable to deliver multiple items that require storage at different temperatures for the duration of the delivery. The delivery container may be a cube, a rectangular prism, a cylinder, or other suitable shape constructed of an insulating material. The insulating material is constructed of layers of cardboard or other insulating materials and plastic bags or other plastic film. The delivery organization may position panels in the delivery container to separate two or more compartments of the delivery container, each compartment to be cooled to a different temperature than the other compartments. The delivery organization determines an appropriate coolant to cool each compartment based on heat transfer requirements of the compartments and positions the coolant in the bottom surface of the bottom compartment. Items requiring the lowest temperature are placed in the bottom compartment. A panel is placed over the bottom compartment, and the items are placed in the second compartment of the delivery container. A top panel is positioned on the second compartment to seal the second compartment. Items are placed above the second compartment in a third compartment formed between the second compartment and the insulation layer of the delivery container.

In certain other example aspects described herein, methods to prepare the container and to select the coolant are provided.

These and other aspects, objects, features, and advantages of the example embodiments will become apparent to those having ordinary skill in the art upon consideration of the following detailed description of illustrated example embodiments.

DETAILED DESCRIPTION OF EXAMPLE EMBODIMENTS

Overview

Figure 1:
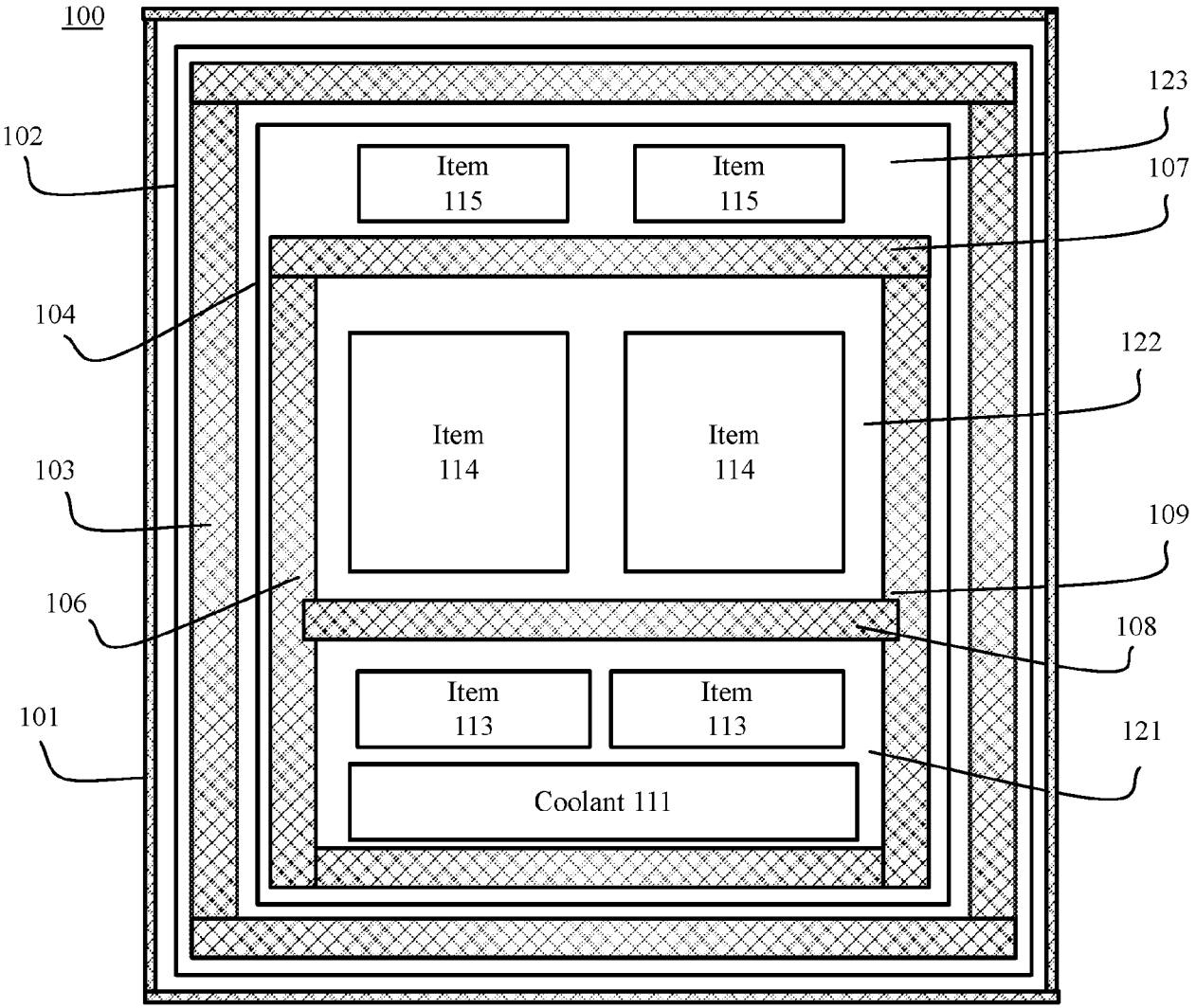
FIG. 1 is an illustration depicting a cross section of a side view of a delivery container with multiple cooled compartments, in accordance with certain example embodiments.

The example embodiments described herein provide a segmented container wherein different segments of the container are maintained at different temperatures through the use of insulated barriers. In an example embodiment, a delivery organization receives an order to deliver one or more products to a user. In an example, the user has ordered products from a merchant to be delivered to the residence of the user. Alternatively, the delivery organization is the merchant and is delivering products sold by the delivery organization. Alternatively, the delivery organization receives products to ship from one user to a second user.

One or more of the products for delivery may require cooling to prevent spoiling, to ensure product stability, to provide a better user experience, or for any suitable reason. In the example, products in the single delivery container require different temperatures. In many of the examples herein, the products require cooling below ambient temperatures for delivery. However, in alternate examples, the products may require heating above ambient temperatures. Instead of coolants, the shipper may employ heating devices that will raise the temperature in the delivery container. In other examples, the coolants or other devices are provided to control other environmental factors, such as humidity.

In an example, one or more products require cooling to less than 40 degrees F. but above approximately 32 degrees F., one or more products require cooling to less then 32 degrees F. and typically approximately 0 degrees F., and one or more products require cooling to less than 50 degrees F. and typically approximately 45 degrees. The delivery organization configures a segmented container for shipping each of the groups of products at each temperature. For example, if a greater volume of products requires shipping at 0 degrees F., then the compartments for those products may be larger.

The size of the compartments may be varied by moving the panels that divide the compartments. The panels may be affixed to the walls of the container by any suitable means. For example, the wall of the container may have inset grooves into which the panels may slide or inserted via spring force and thus be affixed to the walls of the container. The grooves are set at regular intervals to allow the size of the compartments to be varied as needs arise. Alternatively, the wall of the container may have tabs, clips, or any other suitable connectors that may be used to affix the panel to the walls of the container. Alternatively, the panels may be constructed of multiple walls, such as four walls, that allow the panels to be self-supporting. That is, the panels may not require any connection to the walls of the container to divide the compartments.

The thickness and composition of the panels and the container vary between embodiments to allow for a preferred rate of heat transfer with the coolant. That is, the panels separating the compartments may be composed of a particular thickness of material (or multiple layers to achieve the desired thickness) to allow each compartment to be cooled to a particular temperature. In a preferred example, the panels are composed of cardboard or other recyclable material. Alternatively, the panels may be composed of any preferred material such as, polystyrene foam, cellulose, plastic, or any other suitable material.

The container and panels may be similarly composed of one or more materials to provide a required amount of insulation, rigidity, strength, or other required characteristics for the container. In an example, the container is composed of a cardboard outer shell with alternating layers of cardboard and plastic film inside the container walls. The term cardboard as used herein represents any recyclable or environmentally friendly material such as corrugated cardboard, cellulose, or any other material that is manufactured from a recyclable material or is itself recyclable. For example, the container comprises a first cardboard container/layer for enclosing the items, a plastic bag or plastic film enclosing the first cardboard container/layer, a second cardboard container/layer for enclosing the plastic bag and first cardboard container/layer, a second plastic bag or plastic film for enclosing the second cardboard container/layer, and then an outer cardboard container for enclosing the second plastic bag. The alternating layers of plastic and cardboard provide a required amount of waterproof insulation while remaining recyclable. In another example, a non-recyclable material may be used instead of cardboard. For example, a foam material may be used.

The delivery organization determines the type and/or amount of coolant needed to maintain the temperature in each compartment. The coolant required may be based on factors such as the mass and the thermal conductivity of the products in the compartments, the ambient temperature, the amount of time that delivery is expected to take, thickness of the panels and the container walls, the material of the panels and the container, the temperature of the items at the time of packing, and any other suitable factors. Based on these factors, the delivery organization selects an appropriate coolant and a particular amount of the coolant. A larger amount of coolant may cause a lower temperature to be maintained in each of the compartments, a temperature to be maintained for a longer period of time, or both. Certain coolants may cause the temperature to be lower than other coolants. For example, dry ice may cause the temperature to be lower than the temperature caused by water ice.

After segmenting the container into compartments and selecting the appropriate amounts of coolant, the delivery organization places the coolant in the delivery container. In the example, a particular type of coolant is placed in the bottom compartment of the container. In certain examples, the items requiring the lowest temperature storage are placed in the compartment with the coolant. The delivery organization may place a tray or panel over the coolant to support the items in the next compartment. The tray may have holes, vents, or other means of regulating air flow between the coolant and the products.

The products are placed on the one or more trays or panels in the appropriate compartment of the container. In an example, another panel is placed over one or both of the products. This panel may allow another layer of products or coolant to be placed in the third compartment over the products. The top of the delivery container is then affixed to the container to seal the container.

The coolant cools the compartment to an equilibrium temperature. The equilibrium temperature may vary as the coolant melts, warms, evaporates, sublimates, or otherwise loses its cooling effect. In the example, the bottom compartment is cooled to less than 32 degrees F., such as 0 degrees F., and the middle compartment is cooled to less than 40 degrees F., such as 32 degrees F., while the top compartment is cooled to less than 50 degrees, such as 45 degrees F., in each case when reaching equilibrium temperature after packing of the container. The thickness and insulating capacity of the panels and the container walls may be varied to achieve the desired temperature in each compartment.

In other embodiments, the compartments are configured in a horizontal row instead of a vertical column. That is, the coolant may be on one side of the container, and the compartments are divided to be next to each other in a row.

The container is delivered to the user in any suitable manner, such as by the delivery organization itself, a delivery service, a postal service, a courier, or any other suitable delivery organization or person. The user receives the delivery container and removes the items for use or storage.

By using and relying on the methods and systems described herein, the user may receive a single container that contains multiple products that are maintained at different temperatures. As such, the systems and methods described herein may reduce a number of containers required to ship a particular set of products. These systems and methods will reduce waste, container usage, shipping container volume, shipping cost, and the total number of containers the user will be required to sort. Further, the products in the containers will have reduced damage from overheating or overcooling.

Conventional shipping containers are constructed of materials, such as polystyrene foam, which are not recyclable or environmentally friendly. Using cardboard and plastic bags allows the shipping container to achieve the benefits of the multiple cooled compartments, which are cooled at different temperatures, while still being recyclable. A delivery organization using the invention will be able to use fewer containers because a conventional delivery would ship differing temperature items in different containers. Combined with the recyclable nature of the materials in the invention, the delivery organization would use fewer containers and would further be able to recycle the containers that are used. These benefits make for a significantly improved shipping experience.

DETAILED DESCRIPTION

Turning now to the drawings, in which like numerals represent like (but not necessarily identical) elements throughout the figures, example embodiments of the present technology are described in detail.

FIG. 1 is an illustration depicting a cross section side view of a delivery container 100 with multiple cooled compartments 121, 122, 123, in accordance with certain example embodiments.

In an example, a delivery organization receives an order to deliver one or more products to a user. For example, the user has ordered products from a merchant to be delivered to the residence of the user. Alternatively, the delivery organization is the merchant and is delivering products sold by the delivery organization. Alternatively, the delivery organization receives products to ship from one user to a second user. The products ordered are indicated in FIG. 1 as one or more items 113, one or more items 114, and one or more items 115.

In the example, the items 113 require cooling to less than 32 degrees F. and typically approximately 0 degrees F., the items 114 require cooling to less than 40 degrees F. and typically above approximately 32 degrees F., the items 115 require cooling to less then 50 degrees F. and typically above approximately 45 degrees F. These temperatures are only examples of typical temperature requirements for different products. Any suitable temperature may be requested or utilized.

In alternate examples, the items may require heating above ambient temperatures. Instead of coolants, the shipper may employ heating devices that will raise the temperature in the delivery container. The functions of the methods described herein may be applied to an environment requiring heating. Other examples may be directed to controlling other environmental factors, such as humidity.

The delivery organization desires to deliver all the items 113, 114, 115 in a single delivery container 100. In an example, the container 100 is a box that is substantially a cube. In another example, the container 100 is a rectangular prism. Any other suitably shaped container 100 may be used, such as a cylinder. The container wall 101 may be constructed of cardboard, foam, cellulose, metal, plastic, or any other suitable material. The container wall 101 may be constructed of a combination of materials, such as a plastic shell with a foam liner and foam panels. The materials may be selected based on the heat transfer properties of the materials. In an example, the container wall 101 is constructed of an insulating material, such as a foam material to reduce the heat flowing into the interior of the container 100. In an example, the materials are selected based on factors affecting the environmentally friendly nature of the material. For example, the materials may be selected because the materials are recyclable or are made from recycled materials.

In an example, the container 100 is composed of a cardboard container wall 101 with alternating layers of cardboard and a plastic film inside the container walls. The use of the term cardboard represents any recyclable or environmentally friendly material such as corrugated cardboard, cellulose, or any other material that is manufactured from a recyclable material or is recyclable itself. The plastic film may be a plastic bag, a plastic sheet, or any other suitably shaped plastic layer. For example, the container 100 comprises a first cardboard container 106 with a cardboard lid 107 for enclosing the coolant and items 113, 114, a plastic bag 104 or plastic film enclosing the first cardboard container 106 and the items 115, the insulating material 103 enclosing the plastic bag 104 and first cardboard container 106 and the contents of container 106, a second plastic bag 102 or plastic film for enclosing the insulating material 103, and then an outer cardboard container 101 for enclosing the second plastic bag 102.

The alternating layers of plastic and cardboard provide a desired amount of waterproof insulation while remaining recyclable. The cardboard and plastic layers prevent a liquid from an item 113, 114, 115 or coolant 111 from leaking from the container 100. The cardboard and plastic layers similarly prevent a liquid from the outside of the box from penetrating to the items 113, 114, 115. The cardboard and plastic layers provide a method of trapping air within the layers to serve, along with the materials themselves, as thermal insulation. The cardboard and plastic layers serve as an environmentally friendly, yet effective, alternative to foam or other manufactured insulators. When a plastic bag is serving as the plastic layer, the mouth of a plastic bag may be sealed at the top or by tying the bag closed or otherwise sealing the opening. In another example, the plastic bag is sealed by melting the bag to form a seal. In another example, a tie wrap or other binding is used to seal the opening of the bag.

Figure 2:
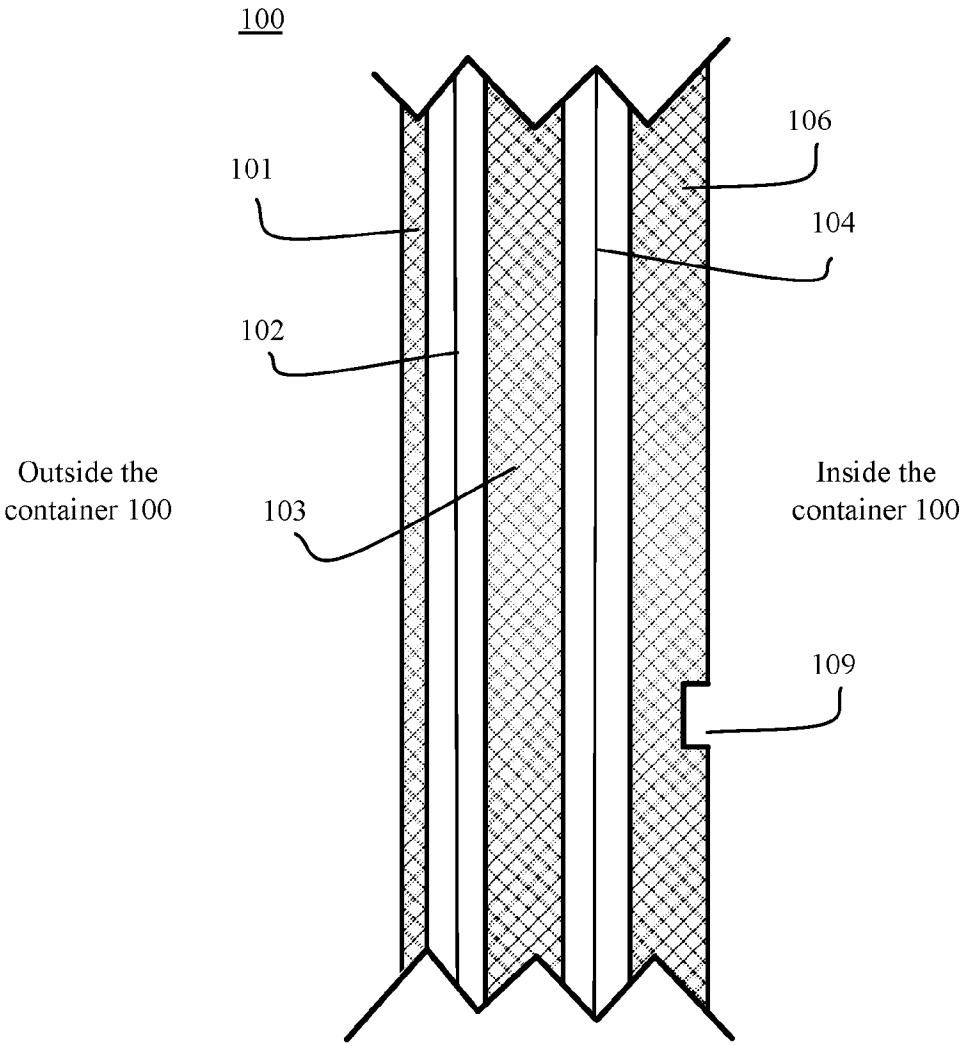
FIG. 2 is an illustration depicting an expanded cross section of a sidewall of the container, in accordance with certain example embodiments.

FIG. 2 is an illustration depicting an expanded cross section of a sidewall of the container, in accordance with certain example embodiments. The expanded view is shown to illustrate the cardboard and plastic layers in a typical sidewall construction.

The portion of a cross section of the sidewall of the container 100 is shown with a first cardboard container 106 wall on the inside layer of the container 100, a plastic bag 104 enclosing the first cardboard container 106, an insulating material 103 wall for enclosing the plastic bag 104 and first cardboard container 106, a second plastic bag 102 for enclosing the insulating material 103, and then an outer cardboard container 101 wall for enclosing the second plastic bag 102.

The section of the first cardboard container 106 is shown with a groove 109. The groove 109 allows an edge of a panel, such as panel 108 to be inserted into the groove 109. When inserted into the groove 109, the panel 108 is fixed into a particular position to create a particular desired size of compartments 121 and 122. Alternatively, the panel 108 has four sidewalls with a lid and is self-supporting. In this way, the four sides are placed into the compartment 121 or 122 and the panel 108 is placed as a lid on the four sides for support.

Returning to FIG. 1, the panel 108 and the lid 107 may be selected to reduce the heat flowing into the coolant compartment 121 of the container 100 from other compartments, such as from compartment 122 and to compartment 123. The panel 108 and lid 107 may be constructed of cardboard, foam, cellulose, metal, plastic, or any other suitable material. The panel 108 and lid 107 may be constructed of a combination of materials, such as a plastic shell with a cardboard liner or a plastic shell with a foam liner and foam panels. The materials may be selected based on the heat transfer properties of the materials.

The lid 107 may be constructed in any manner to close and seal the box enclosing compartments 121, 122. For example, the lid 107 may be constructed or two or four flaps that are configured to fold down and be sealed with tape or any suitable sealant. The lid 107 may be a solid section made of a similar material as the sidewalls that fits slips onto the sidewalls of the box 103 and provides a seal. The lid 107 may be constructed of a different material than the box 103 to provide a desired amount of insulation. Any suitable lid 107 may be employed.

In an example, the panel 108 and lid 107 are constructed of an insulating material, such as a layered cardboard and plastic. The panel 108 and lid 107 may comprise a single vent or pressure relief component to allow the pressure created by the coolant to be vented to the atmosphere. The vent may be a simple hole in the panel 108 and in the lid 107. The vent may be a relief device that reseals when the pressure is equalized. Any suitable orifice, hole, relief device, damper, or other device or configuration may be employed to allow the pressure to be relieved. In an example, the vents allow air flow from the coolant compartment 121, through the second compartment 122, through the third compartment 123, and through any and all layers of insulation and packaging, such as 101, 102, and 104. This configuration allows the pressure from the coolant to be released to the atmosphere.

In an example, the vents allow the pressure to be released from the top of the container 100. Venting through the top of the container 100 allows the warmest air to be released via the vent. The term "air" is being used herein to represent any and all gasses that exist in the container 100 including gasses that are sublimated or released from the coolant 111. That is, when cooler air from the bottom compartment 121 of the container 100 expands and vents upwards, the cooler air exchanges heat with the next compartment 122. As air expands upwards to compartment 123, the air is warmer than the air that is leaving compartment 121. In this way, warmer air leaves compartment 123 and is vented to the atmosphere from the top of the container 100. Thus, the container 100 effectively expels warmer air while retaining more of the cooler air. Conversely, if the vents were directed to expel air from lower in the container 101, air flow would be reduced. Further, cooler air would be expelled from the lower portion while warmer air would gather in the upper compartments 122, 123. This process would reduce the effective cooling of the container 100 and would result in higher temperatures in compartments 122, 123.

Figure 3:
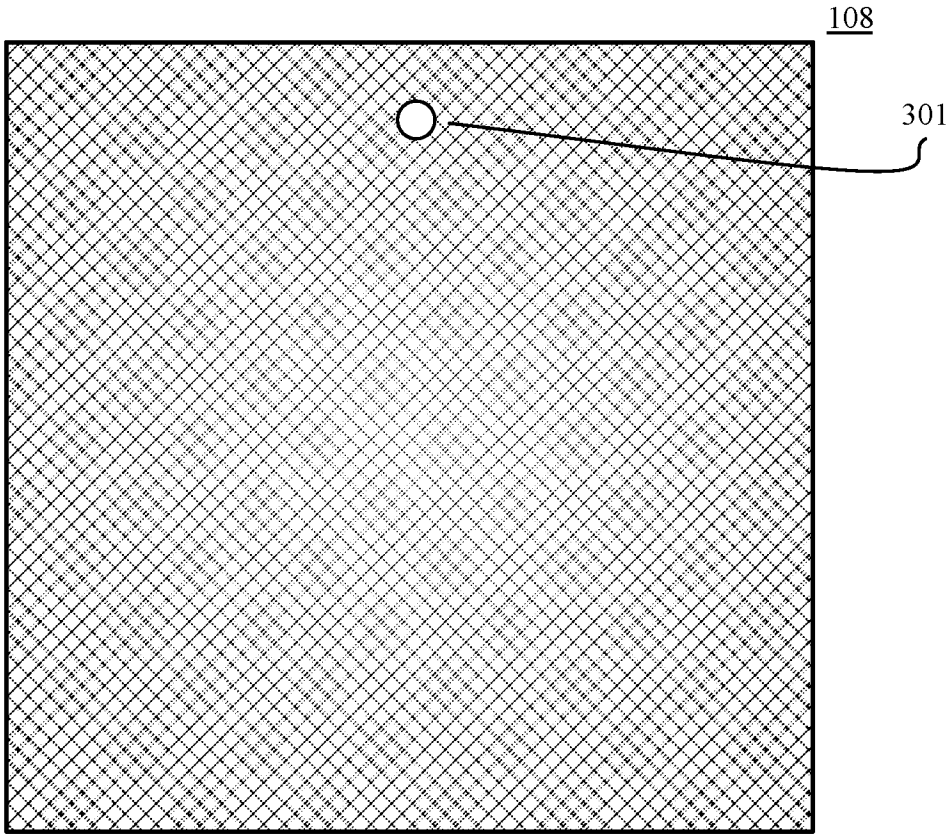
FIG. 3 is an illustration depicting a top view of a panel to separate compartments of the container, in accordance with certain example embodiments.

FIG. 3 is an illustration depicting a top view of a panel 108 to separate compartments of the container, in accordance with certain example embodiments. The panel 108 is shown with a vent 301 to allow pressure from the compartment 121 below the panel 108 to be relieved through the vent into compartment 122. The vent is shown as an orifice in FIG. 3, but may be implemented as any of the vent types discussed herein.

Returning to FIG. 1, in an alternate example, the panel 108 and lid 107 may not be designed to be insulating. For example, panel 108 and lid 107 may be constructed of a material with sufficient structural integrity to support the items 113, 114, 115 above the coolant 111, but with holes or vents to allow air to flow between the coolant and the compartments 121, 122, 123, respectively.

The container 100 can be sized to hold all of the items 113, 114, 115 or a selected portion of the items 113, 114, 115. Based on the items that are to be shipped at different temperatures, the delivery organization configures the panels 108 and the size of the box 103 being placed in the container 100. In the example, two cooled temperatures are required so the delivery organization positions a central panel 108 in the container 100 to divide the container 100 into two compartments 121, 122. In FIG. 1, the compartments 121, 122 are shown as being substantially equal in size.

In an alternate example, a panel 108 is not used, but instead container 103 is formed by two separate boxes. That is, a first box may be placed in the container 101 to form compartment 121, and a second box is placed on top of the first box to form compartment 122. Similarly, a third box may be placed on the second box to form compartment 123. In this example, the three boxes may have hole or vents provided to allow air to flow between the boxes to cool the compartments 122, 123. For example, the cooling air from the coolant compartment 121 flows out of the first box into the second box to cool compartment 122 and into the third box to cool compartment 123. The holes or vents may be sized and numbers as described herein to provide a desired amount of cooling to compartments 122, 123.

The appropriate coolant 111 to control the temperature in each compartment 121, 122, 123 is placed into the container 100. The coolant 111 required may be based on factors such as the mass and the thermal conductivity of the products 113, 114, 115 in the compartments 121, 122, 123, the ambient temperature, the amount of time that delivery is expected to take, the thickness of the components of the container 100, the material of the components of the container 100, and any other suitable factors. Based on these factors, the delivery organization selects an appropriate coolant 111 and a particular amount of coolant 111. A larger amount of coolant 111 may cause a lower temperature to be maintained, the temperature to be maintained for a longer period of time, or both. Certain types coolant 111 may cause the temperature to be lower than another coolant. For example, dry ice (solid carbon dioxide) may cause the temperature in the compartments 121, 122, 123 to be lower than the temperature caused by water ice.

In the example, compartment 121 is selected to store the one or more items 113 at less than 32 degrees F. but approximately 0 degrees F. In the example, based on the size of the items 113, the expected delivery time, the insulation properties of the container 100 and the other components, the ambient temperature, and any other suitable factors, the coolant 111 selected for use is dry ice. Any other suitable coolant may be selected that will cool the compartment 121 to an appropriate temperature. The coolant may be any suitable cooling material, such as water ice, dry ice, or any suitable coolant. The coolant may cool the environment inside the container 101 by melting, sublimating, or just absorbing heat.

The coolant 111 is placed in the bottom of the container 100. The items 113 are placed in the compartment 121 with the coolant 111. In an example, the coolant 111 is in a package or other material that prevents contact of the items 113 with the coolant. For example, the coolant 111 may be covered with a tray, a plastic cover, a section of fabric/plastic, or any other material or structure to protect the item 113 from contacting the coolant 111 directly. Alternatively, the items 113 may be affixed to the wall of the first cardboard container 106 in any suitable manner. For example, the items 113 may be affixed to the wall of the first cardboard container 106, wrapped in bubble wrap, placed in packing foam, or suspended in packing material.

The panel 108 is placed over the coolant 111. For example, panel 108 may be a solid panel or the panel 108 may have holes, vents, or other means of regulating air flow between the coolant 111 and the products 113. The panel 108 may be affixed to the walls 101 of the container 100 by any suitable means. For example, the container wall 101 may have inset grooves 109 into which the panels may slide and thus be affixed to the walls of the container. The grooves 109 may be set at regular intervals to allow the size of the compartments 121, 122 to be varied as needs arise. Alternatively, the container wall 101 may have tabs, clips, or any other suitable connection that may be used to affix the panel 108 to the walls 101. The panel 108 is affixed in a position to allow for the size of the coolant 111. For example, if a greater volume of coolant 111 is required, then the panel 108 may be positioned higher up the container wall 101.

In the example, compartment 122 is selected to store the one or more items 114 below 40 degrees F., such as approximately 32 degrees F. Based on the size of the items 114, the expected delivery time, the ambient temperature, and any other suitable factors, the delivery organization may select insulation properties of the container 100, the insulating 106, the panel 108, and the top panel 107, the size of the compartment 122, the size and placement of the vent, and other suitable factors to achieve the desired temperature in compartment 122.

After affixing the panel 108, the items 114 may be placed in the compartment 122. The items 114 may rest on the panel 108 that is over the coolant 111. The items 114 may be affixed to the wall of the first cardboard container 106 in any suitable manner. For example, the items 114 may be affixed to the wall of the first cardboard container 106, wrapped in bubble wrap, placed in packing foam, or suspended in packing material.

A top panel 107 is placed on the container 100 to close or seal the container 100. The top panel 107 may be any type of lid or top that can close the container 100 for shipping. The top panel 107 may be a separate panel that fits snuggly over the lip of the wall of the first cardboard container 106. The top panel 107 may be a panel that is connected on one side to the wall of the first cardboard container 106 and folds over to seal the first cardboard container 106. The top panel 107 may be composed of multiple panels that are each connected to the wall of the first cardboard container 106 and fold together to form a single top connected to the wall of the first cardboard container 106. The top panel 107 may be a separate panel that fits snuggly inside the wall of the first cardboard container 106, such as in a groove in the container wall 101. Any type of top panel 107 may be used to close or seal the first cardboard container 106. The first cardboard container 106 may be sealed shut with tape, glue, or any other suitable sealing material.

In this example, after the top panel 107 is sealed, additional items 115 may be placed in the compartment 123. Compartment 123 may be created by placing items on top of the top panel 107 of the first cardboard container 106 that is inside the container 100. When sealed within the insulating panels 103, the plastic bags 102, 104, and the container walls 101, the container 100 will encapsulate the compartment 123. In an alternate embodiment, the compartment 123 may be created by placing an additional box, similar to box 106, on top of the top panel 107.

The compartment 123 by virtue of being conjoined with compartment 122 may experience some cooling effect, but the effect may be less than in compartment 122. In the example, compartment 123 is cooled to a temperature less than 50 degrees F., such as 45 degrees F. By virtue of being the compartment farthest removed from the coolant 111, the temperature of compartment 123 is warmest of the three compartments 121, 122, 123.

After placing the items 115 in the compartment 121, the container wall 101 is sealed shut in any suitable manner, such as by taping the seams shut or by using an adhesive for sealing the container wall 101. In an example embodiment, the compartment 121 is sealed with a lid that affixes to the insulating panels 103. In an example, the plastic 104, must be sealed, tied, or otherwise closed before the lid may be attached to the insulating panels 103. The outer container 101 may then be sealed or shut in any suitable manner.

The container 100 is delivered to the desired user with the cooled items inside. Upon arrival, the items in the compartments are at the desired temperatures as specified in the examples herein. The user receiving the container 101 may unpack the items from the container 100 and store the items in an appropriate cooled environment.

In the example, the components of the container 100, such as the first cardboard container 106, the container walls 101, the plastic bags 102, 104, the insulating panels 103, and any other appropriate components may be recycled or disposed of in any appropriate manner.

The example systems, methods, and acts described in the embodiments presented previously are illustrative, and, in alternative embodiments, certain acts can be performed in a different order, in parallel with one another, omitted entirely, and/or combined between different example embodiments, and/or certain additional acts can be performed, without departing from the scope and spirit of various embodiments. Accordingly, such alternative embodiments are included in the inventions described herein.

Although specific embodiments have been described above in detail, the description is merely for purposes of illustration. It should be appreciated, therefore, that many aspects described above are not intended as required or essential elements unless explicitly stated otherwise. Modifications of, and equivalent components or acts corresponding to, the disclosed aspects of the example embodiments, in addition to those described above, can be made by a person of ordinary skill in the art, having the benefit of the present disclosure, without departing from the spirit and scope of embodiments defined in the following claims, the scope of which is to be accorded the broadest interpretation so as to encompass such modifications and equivalent structures.

What is claimed is:

1. A container assembly with multiple temperature compartments, comprising:

a first set of container walls forming a bottom surface, four side walls, and a top surface;

an insulating layer positioned inside the first set of container walls, the insulating layer being formed of alternating layers comprising at least one substrate layer and one plastic layer;

a second set of container walls comprising a second set of container side walls, a top panel, and a second bottom surface, the second set of container walls being disposed inside the insulating layer;

a coolant disposed inside the second set of container walls and relative to the second bottom surface, the coolant having cooling characteristics to maintain a temperature of items in a first compartment inside the second set of container walls at or below a first temperature for a period of time;

a dividing panel positioned inside the second set of container walls and dividing the interior of the second set of container walls into the first compartment comprising the coolant and a second compartment, the dividing panel being constructed to allow a desired rate of heat transfer from the second compartment to the first compartment such that the temperature of items in the second compartment are at or below a second temperature that is different from the first temperature of the first compartment for a period of time, wherein the container assembly further comprises a third compartment formed outside the top panel of the second set of container walls, and wherein the bottom surface, the four side walls, and the top surface of the first set of container walls are sealed to enclose the container assembly.

2. The container assembly of claim 1, wherein the at least one substrate layer comprises corrugated cardboard.

3. The container assembly of claim 1, wherein the at least one plastic layer comprises a plastic bag.

4. The container assembly of claim 1, wherein the dividing panel separating the first compartment from the second compartment comprises a vent to allow air to flow between the first compartment and the second compartment.

5. The container assembly of claim 1, wherein the top panel of the second set of container walls that separates the second compartment from the third compartment comprises a vent to allow air to flow between the second compartment and the third compartment.

6. The container assembly of claim 1, wherein the top surface of the first set of container walls comprises a vent to allow air to flow from the third compartment to an area outside of the container assembly.

7. The container assembly of claim 1, wherein the container walls and the dividing panel are made from recyclable materials.

8. The container assembly of claim 1, wherein the insulating layer is made from recyclable materials.

9. The container assembly of claim 1, wherein the first set of container walls forms a rectangular prism.

10. The container assembly of claim 1, wherein the dividing panel is positioned such that the first compartment and the second compartment have different sizes.

11. The container assembly of claim 1, wherein the third compartment is formed inside the insulating layer.

12. The container assembly of claim 11, wherein the top panel of the second set of container walls is further constructed to allow a desired rate of heat transfer from the third compartment to the second compartment such that a temperature of items in the third compartment are at or below a third temperature that is different from the first temperature and the second temperature.

13. The container assembly of claim 1, wherein the coolant is dry ice.

14. The container assembly of claim 1, wherein the coolant is water ice.

15. The container assembly of claim 1, wherein the coolant is selected based on one or more of an ambient temperature; desired temperatures of the first, second, and third compartments; and an expected time for maintaining the first temperature and the second temperature at or below desired temperatures.

16. The container assembly of claim 1, wherein the first set of container walls comprises horizontal grooves therein, and wherein the dividing panel is placed into the horizontal grooves in the container walls such that the dividing panel is affixed to the container wall.

17. The container assembly of claim 1, wherein materials of the second set of container walls and the dividing panel are determined based on one or more of an ambient temperature; maintained temperatures of the first, second, and third compartments; and an expected time until delivery of the container assembly.

18. The container assembly of claim 1, wherein the second set of container walls comprise at least an outer plastic layer, a middle cardboard layer, and an inner plastic layer.

19. A method to assemble and pack a container assembly for cooling items, comprising:

receiving a plurality of items, the items requiring at least three different temperatures for storage;

selecting a first container with an outer container wall forming a top surface, a bottom surface and four side walls;

positioning an insulating layer inside the first container, the insulating layer being formed of alternating layers comprising at least one substrate layer and one plastic layer;

positioning a second container inside the insulating layer, the second container comprising a second set of container side walls, a bottom wall, and a top wall;

depositing a coolant in the second container relative to the bottom wall, the coolant having cooling characteristics to maintain a temperature of items in a first compartment in the second container at or below a first temperature;

positioning a dividing panel inside the second container to divide the interior of the second container into the first compartment comprising the coolant and a second compartment, the dividing panel being constructed to allow a desired rate of heat transfer from the second compartment to the first compartment such that the temperature of items in the second compartment are at or below a second temperature that is different from the first temperature;

forming a third compartment, the third compartment formed outside the top panel of the second set of container walls, and wherein the bottom surface, the four side walls, and the top surface of the first set of container walls are sealed to enclose the container assembly.

20. The method of claim 19, wherein the at least one substrate layer comprises corrugated cardboard.

* * * * *